US010522933B2

(12) United States Patent
Zieman

(10) Patent No.: US 10,522,933 B2
(45) Date of Patent: Dec. 31, 2019

(54) SELF-LOCKING ELECTRICAL CABLE RETAINER

(71) Applicant: Cisco Technology, Inc., San Jose, CA (US)

(72) Inventor: Christopher E. Zieman, Chapel Hill, NC (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 16/049,463

(22) Filed: Jul. 30, 2018

(65) Prior Publication Data

US 2019/0006780 A1 Jan. 3, 2019

Related U.S. Application Data

(63) Continuation of application No. 15/636,864, filed on Jun. 29, 2017, now Pat. No. 10,038,269.

(51) Int. Cl.
*H01R 13/422* (2006.01)
*H01R 13/52* (2006.01)

(52) U.S. Cl.
CPC ..... *H01R 13/4223* (2013.01); *H01R 13/5205* (2013.01)

(58) Field of Classification Search
CPC ..... H01R 13/4223; H01R 13/506; H01R 13/518; H01R 13/5205
USPC ..... 439/468, 595, 248
See application file for complete search history.

(56) References Cited

U.S. PATENT DOCUMENTS 4,634,204 A * 1/1987 Detter ..... H01R 13/641 439/347
5,127,847 A * 7/1992 Kato ..... H01R 13/6272 439/357
5,588,080 A * 12/1996 Kawamura ..... G02B 6/3855 385/72
5,628,649 A * 5/1997 Yagi ..... H01R 13/6272 439/354
6,149,315 A * 11/2000 Stephenson ..... G02B 6/266 385/60
6,547,450 B2 4/2003 Lampert
6,780,045 B2 * 8/2004 Shuey ..... H01R 13/6272 439/352

(Continued)

OTHER PUBLICATIONS

"MOPAR Transfer Case Shift Cable Retainer Clip," morris4x4center, Copyright 1997-2017 Bestop Morris LLC, pp. 1-7.

*Primary Examiner* — Tulsidas C Patel
*Assistant Examiner* — Peter G Leigh
(74) *Attorney, Agent, or Firm* — Polsinelli PC

(57) ABSTRACT

The disclosed technology relates to self-locking electrical cable retainers. The cable retainer has a panel with a plurality of bores disposed within and extending longitudinally through the panel. Each bore of the plurality of bores is configured to receive individual cables. The cable retainer also has a plurality of latches. Each latch of the plurality of latches corresponds to a bore. Each latch has a first and second post. The first post is configured to bend the latch to a disengaged position through engagement with a corresponding cable as the cable is pushed longitudinally within the bore. The second post is configured to retain the corresponding cable within the respective bore when the latch returns to an engaged position.

18 Claims, 7 Drawing Sheets

(56) References Cited

U.S. PATENT DOCUMENTS 7,043,834 B2 * 5/2006 Endo ..... H01R 13/641 29/842
7,261,603 B2 * 8/2007 Takahashi ..... H01R 13/4361 439/595
7,326,074 B1 * 2/2008 Lim ..... H01R 13/629 439/352
7,402,087 B2 * 7/2008 Wang ..... H01R 13/113 439/382
7,470,138 B1 * 12/2008 Chen ..... H01R 13/506 439/352
7,544,081 B2 * 6/2009 Lim ..... H01R 13/4361 439/352
7,708,589 B2 5/2010 Shuey
8,016,606 B1 * 9/2011 Kwan ..... H01R 13/641 439/352
8,323,046 B1 * 12/2012 Daugherty ..... H01R 13/639 439/352
8,585,426 B2 11/2013 Zerebilov et al.
8,727,816 B2 * 5/2014 Takahashi ..... H01R 13/4361 439/595
8,747,146 B2 * 6/2014 Brown ..... H01R 13/641 439/489
9,054,458 B1 * 6/2015 Ng ..... H01R 13/641
9,331,426 B2 * 5/2016 Adams ..... H01R 13/629
9,425,534 B2 * 8/2016 Schmidt ..... H01R 13/6272
9,478,906 B2 * 10/2016 Myer ..... H01R 13/6273
9,490,576 B2 * 11/2016 Plazio ..... H01R 13/641
2009/0130902 A1 * 5/2009 Hall ..... H01R 13/4361 439/595
2011/0045683 A1 * 2/2011 Foung ..... H01R 13/6272 439/352
2017/0033490 A1 * 2/2017 Wang ..... H01R 13/426
2017/0040741 A1 * 2/2017 Droesbeke ..... H01R 13/506
2017/0077646 A1 * 3/2017 Kim ..... H01R 13/6272

* cited by examiner

SELF-LOCKING ELECTRICAL CABLE RETAINER

CROSS-REFERENCE TO RELATED APPLICATIONS

This application is a Continuation of U.S. application Ser. No. 15/636,864, filed on Jun. 29, 2017, entitled "SELF-LOCKING ELECTRICAL CABLE RETAINER," the content of which is incorporated herein by reference in its entirety.

TECHNICAL FIELD

This present disclosure relates generally to electrical cable retainers, and more particularly to a self-locking electrical cable retainer.

BACKGROUND

It may be desired to mechanically retain connected electrical cables to prevent accidental disconnect. While some types of electrical cables may include locking mechanisms, others may not. Conventional cable retention mechanisms may employ systems that retain numerous cables with a single locking mechanism. In these systems, removal of the locking mechanism allows any number of the underlying cables to be disconnected thereby increasing the risk that other affected cables may be accidentally disconnected. Other systems may utilize individual retention mechanisms to retain individual cables. These individual retention mechanisms may be too bulky and may otherwise consume too much space. In addition, conventional cable retention mechanisms may require the use of special tools to remove and may further require manipulation of the tool in confined spaces.

BRIEF DESCRIPTION OF THE DRAWINGS

The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

The detailed description set forth below is intended as a description of various configurations of embodiments and is not intended to represent the only configurations in which the subject matter of this disclosure can be practiced. The appended drawings are incorporated herein and constitute a part of the detailed description. The detailed description includes specific details for the purpose of providing a more thorough understanding of the subject matter of this disclosure. However, it will be clear and apparent that the subject matter of this disclosure is not limited to the specific details set forth herein and may be practiced without these details. In some instances, structures and components are shown in block diagram form in order to avoid obscuring the concepts of the subject matter of this disclosure.

Overview

Conventional cable retention mechanisms may employ systems that retain numerous cables with a single locking mechanism. In these systems, removal of the locking mechanism allows any number of the underlying cables to be disconnected thereby increasing the risk that other affected cables may be accidentally disconnected. Other systems may utilize individual retention mechanisms to retain individual cables. These individual retention mechanisms may be too bulky and may otherwise consume too much space. In addition, conventional cable retention mechanisms may require the use of special tools to remove and may further require manipulation of the tool in confined spaces.

The disclosed technology addresses the need in the art for providing a multiport panel with individual port retention mechanisms that are self-opening and self-locking, thereby preventing accidental disconnect. The self-locking cable retention mechanism of the subject technology does not require additional hardware to be attached to the cable or tools to release the retention mechanism. In one aspect, by utilizing a self-opening and self-locking retention mechanism, speed and security of electrical cable installation is increased. In other aspects, the self-locking cable retention mechanism of the subject technology has a minimal footprint and requires minimal area on a panel thereby increasing the port density of the panel in both the X and Y directions.

DETAILED DESCRIPTION

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Figure 1:
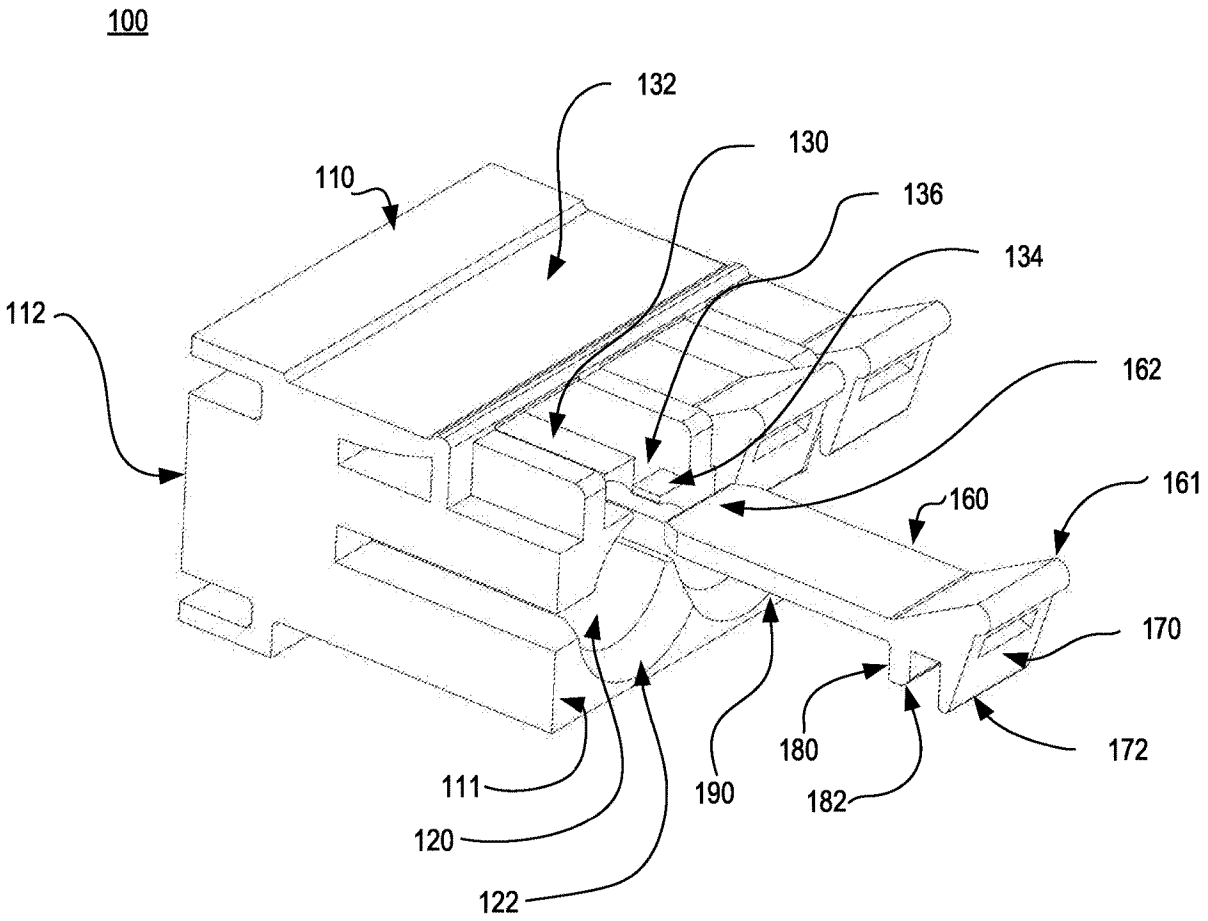
FIG. 1 is an isometric exploded view of a self-locking electrical cable retainer, in accordance with various aspects of the subject technology.

FIG. 1 is an isometric exploded view of a self-locking electrical cable retainer 100, in accordance with various aspects of the subject technology. The cable retainer 100 comprises a panel 110 having a proximal end 111, a distal end 112, and a plurality of bores or ports 120 disposed within and extending longitudinally through the panel 110 from the proximal end 111 to the distal end 112. Each bore of the plurality of bores 120 is configured to receive individual cables. In some aspects, each bore 120 of the plurality of bores may include a chamfer 122 at the proximal end 111 that is configured to guide the cable within and through the bore 120 as the cable is pushed longitudinally and distally toward the panel 110. Each bore 120 may comprise a connector adapted to electrically connect to the cable. The panel 110 may be manufactured from a metal, alloy, polymer, composite, or any other suitable material as would be known by a person of ordinary skill in the art.

The cables may be coaxial cables, communications cables, heliax cables, sheathed cables, multicore cables, paired cables, shielded cables, twinax cable, networking cables, or other cables as may be suitable to a person of ordinary skill in the art.

The cable retainer 100 also includes a plurality of latches 160. Each latch 160 has a proximal portion 161 and a distal portion 162. At the distal portion 162, each latch 160 may have an elongated member 190 having a substantially rectangular cross-section and planar surface. At the proximal portion 161 of the latch 160, the latch 160 may have a first post 170 and a second post 180. The first post 170 may be disposed at a proximal end of the latch 160 and the second post 180 may be disposed adjacent to the first post 170. In one aspect, the latch may be manufactured from a flexible polymer such as a polycarbonate, an alloy, composite, or other flexible and resilient material as may be known to a person of ordinary skill in the art.

In some aspects, a length of the first post 170 may be longer in length than a length of the second post 180. In other aspects, the length of the first post 170 may be substantially the same as the length of the second post 180. In another aspect, the length of the first post 170 may be shorter in length than the length of the second post 180. The first post 170 may have a rounded or chamfered end 172 that is configured to engage an outer surface of a housing or connector of the cable. The first post 170 may also include a substantially planar surface adapted to receive a pushing force from a user's finger to cause the latch 160 to move, bend, or flex to a disengaged position, as discussed below with reference to FIG. 4. The second post 180 may also have a rounded or chamfered end 182 for engaging the outer surface of the housing or connector of the cable.

Figure 2:
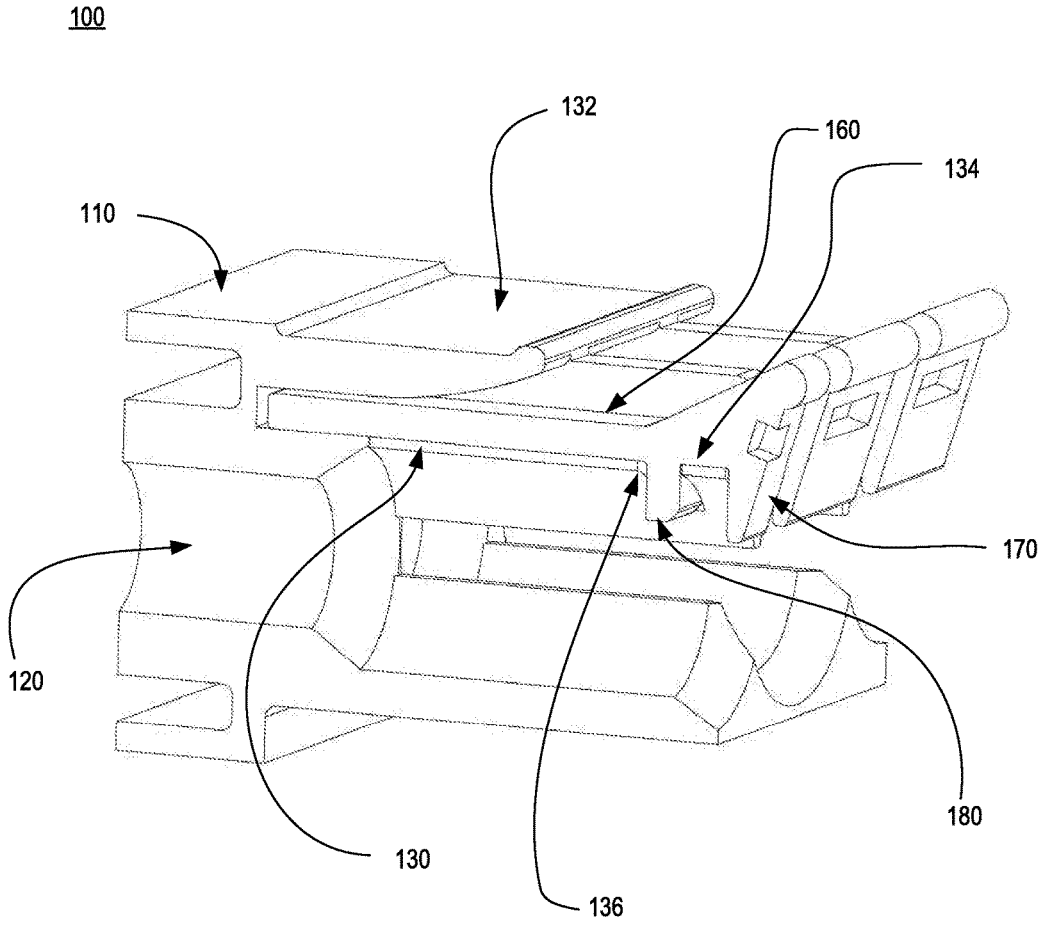
FIG. 2 is a perspective view of a self-locking electrical cable retainer, in accordance with various aspects of the subject technology.

To retain the latch 160 within the panel 110, the panel 110 may have a retainer 132 disposed at a distal portion of the panel 110. The retainer 132 may be configured to receive the distal portion 162 of each latch 160 and may comprise a plurality of slots with each slot having an open proximal end that is sized to accommodate the outer dimension of the elongated member 190 of the latch 160. The slot may be sized slightly larger than the elongated member 190 to allow the elongated member 190 of the latch 160 to slide longitudinally within the retainer 132. In one aspect, each slot may have a curved inner surface having a width at a distal end of the slot that is narrower than a width at the open proximal end of the slot (as shown in FIG. 2) to enable the latch 160 to move, bend, or flex between an engaged and the disengaged position.

In one aspect, the panel 110 may also include a plurality of guides 130 that are each configured to support the elongated member 190 of each latch 160. The guides 130 may comprise planar surfaces extending from the retainer 132 proximally toward the proximal end 111 of the panel 110. The guides 130 may therefore provide a supporting surface for the elongated members 190 of each latch 160 to rest against when the latch 160 is in the engaged position.

The panel 110 may also include a plurality of gaps 136 disposed at a proximal portion of the panel 110 for receiving the second post 180 of each latch 160. Each gap of the plurality of gaps 136 may be disposed adjacent to the guides 130. By receiving the second posts 180 of the latches 160 using the gaps 136, mechanical engagement between each respective second post 180 and gap 136 guides the latch 160 as it moves between the engaged and disengaged positions, as shown in FIGS. 3A-3D.

The panel 110 may further include a plurality of stops 134 disposed at the proximal end 111 of the panel 110 that are configured to mechanically engage a surface of the second posts 180 to thereby retain the cables within their corresponding bores 120. Each stop 134 of the plurality of stops 134 is disposed adjacent to the gaps 136 and is configured to mechanically engage the second posts 180 of the latches 160 to prevent accidental pullout of the cables by loading the second post 180 in shear.

FIG. 2 is a perspective view of a self-locking electrical cable retainer 100 with the latch 160 inserted within the panel 110, in accordance with various aspects of the subject technology. As discussed above with reference to FIG. 1, the cable retainer 100 may include the panel 110 and the plurality of latches 160. The panel 110 may have the plurality of bores 120, retainers 132, guides 130, gaps 136, and stops 134. The latch 160 may include the first post 170 and the second post 180. The latch 160 may be retained within the panel 110 by the retainer 132. The latch 160 may be supported in the engaged position by the guide 130. The latch 160 may be guided between the engaged and disengaged positions via mechanical engagement between the second post 180 and gap 136. The stop 134 may be configured to mechanically engage the second post 180 to provide the second post 180 with a surface to oppose a pullout force applied to a cable.

Figure 3A:
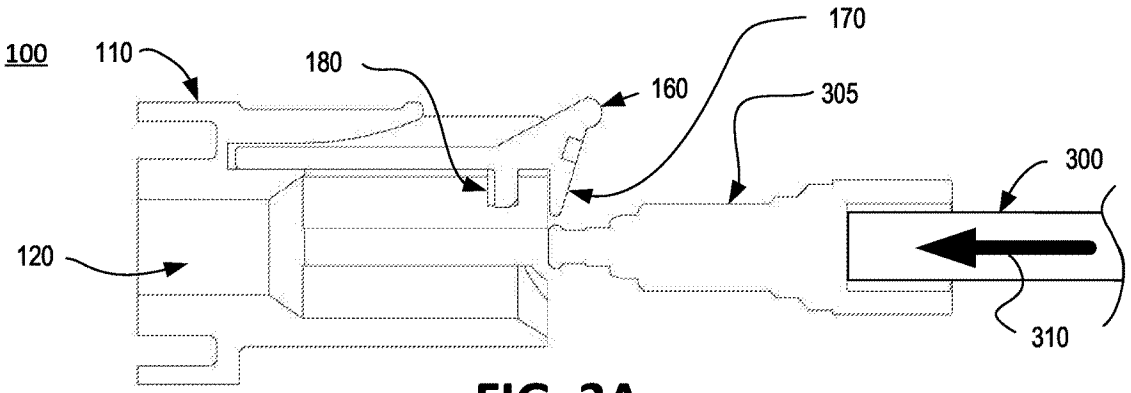
FIGS. 3A, 3B, 3C and 3D are sequenced cross-sectional views of a self-locking electrical cable retainer, in accordance with various aspects of the subject technology.

FIGS. 3A-3D are sequenced cross-sectional views of a self-locking electrical cable retainer 100 demonstrating the process for inserting and retaining a cable 300 within the cable retainer 100, in accordance with various aspects of the subject technology. Referring to FIG. 3A, a cable 300 with a connector 305 is shown outside of the cable retainer 100, moving longitudinally toward the bore 120 of the panel 110 due to a longitudinal pushing force 310. The latch 160 is shown in an initial, engaged position. In the engaged position, the first and second posts, 170 and 180 respectively, are disposed within the bore 120.

Figure 3B:
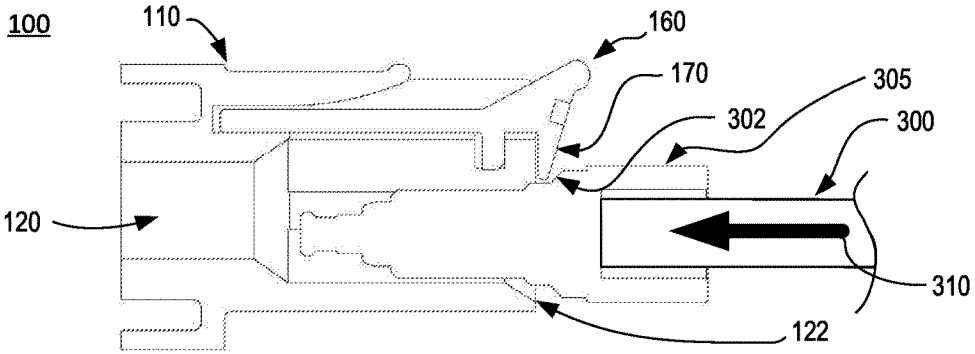

Referring to FIG. 3B, the cable 300 is shown partially within the bore 120 and moving longitudinally toward the bore 120 of the panel 110 due to the longitudinal pushing force 310. The connector or housing 305 has an outer geometry or surface 302 that may comprise a series of steps, chamfers, rounded edges, or surfaces. The connector 305 of the cable 300 may, for example, comprise a compression connector such as an MCX connector. As the cable 300 is moved longitudinally toward the bore 120, the outer surface 302 of the connector 305 of the cable 300 may first contact the chamfer 122 of the bore 120 to guide the cable 300 toward a centerline of the bore 120. As the cable 300 moves toward the bore 120 and is guided by the chamfer 122 toward the centerline of the bore 120, the outer surface 302 of the connector 305 of the cable 300 may engage the first post 170 of the latch 160. The first post 170 may have a rounded or chamfered end to facilitate smooth engagement between the first post 170 and the connector 305 of the cable 300.

Figure 3C:
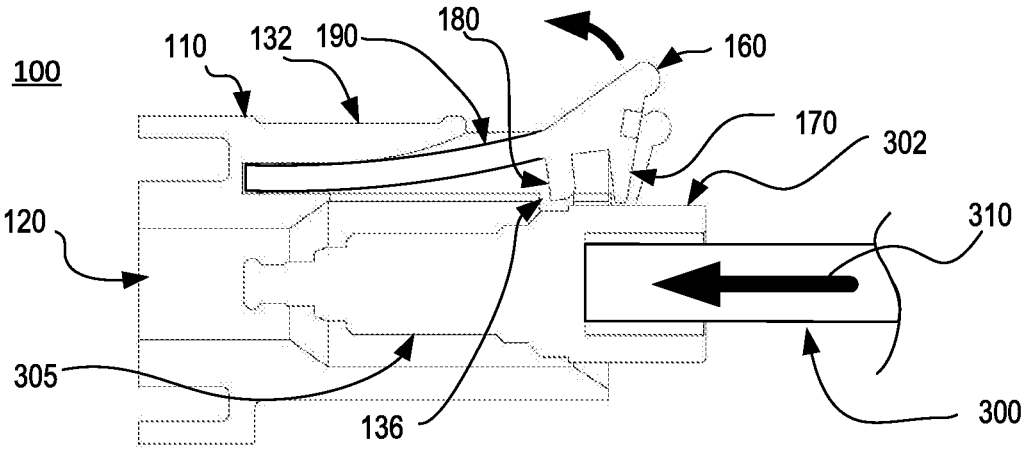

Referring to FIG. 3C, the cable 300 is shown further within the bore 120 and moving longitudinally toward the bore 120 of the panel 110. As the cable 300 is moved longitudinally toward the bore 120 by the longitudinal pushing force 310, the outer surface 302 of the connector 305 of the cable 300 contacts the rounded or chamfered end of the first post 170 causing the latch 160 to automatically move, bend, or flex vertically away from the bore 120 and into the disengaged position. In the disengaged position, the first and second posts, 170 and 180 respectively, are disposed away from the bore 120 and positioned to allow the cable 300 to move within the bore 120 of the panel 110 without interference. Specifically, the elongated member 190 of the latch 160 bends or flexes to allow the first and second posts, 170 and 180 respectively, to be moved away from the bore 120. In one aspect, the curved geometry of the inner surface of the retainer 132 provides sufficient space for the elongated member 190 to bend or flex. As the latch 160 is moved from the engaged position to the disengaged position, the second post 180 moves and slides within the gap 136 to thereby guide the latch 160 from the engaged position to the disengaged position. In some aspects, the second post 180 may include a chamfered or rounded edge to facilitate ease of movement within the gap 136 without interference.

As the cable 300 is further moved longitudinally within the bore 120 of the panel 110, the first post 170 will disengage the outer surface 302 of the connector of the cable 300 thereby causing the latch 160 to automatically move to an intermediate position whereby the second post 180 contacts the outer surface 302 of the connector 305 of the cable 300. In one aspect, the latch 160 moves from the disengaged position to the intermediate position due to the bending or spring-back force of the latch 160. As the latch 160 is moved from the disengaged position to the intermediate position, the second post 180 moves and slides within the gap 136 to thereby guide the latch 160 from the disengaged position to the intermediate position. In some aspects, the chamfered or rounded edge of the second post 180 may also assist in facilitating smooth engagement between the second post 180 and the outer surface 302 of the connector 305 of the cable 300. In some aspects, by utilizing the first post 170 and second post 180 to move, bend or flex the latch 160, the cable retainer 100 utilizes a two-stage actuation scheme to easily manipulate the position of the latch 160 and easily allow the cable 300 to be inserted within the bore 120 without undue resistance.

Figure 3D:
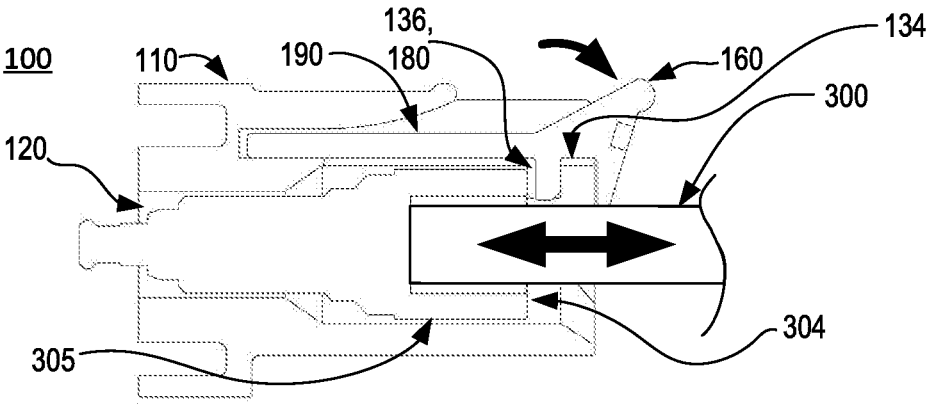

Referring to FIG. 3D, the cable 300 is shown fully inserted within the bore 120 and mechanically retained within the bore 120 of the panel 110. As the cable 300 is moved longitudinally into the bore 120, the connector 305 of the cable 300 moves past the second post 180 thereby causing the second post 180 to no longer cause the latch 160 to bend or flex. The latch 160 thus returns to the engaged position due to the bending or spring-back force of the elongated member 190 of the latch 160. As the latch 160 is moved from the intermediate position to the engaged position, the second post 180 moves and slides within the gap 136 to thereby guide the latch 160 from the intermediate position to the engaged position. In the engaged position, the second post 180 sits within the gap 136 thereby coming into contact with an abutting surface 304 of the connector 305 of the cable 300.

In one aspect, the cable 300 is retained within the bore 120 by mechanical engagement between the abutting surface 304 of the cable 300 and the second post 180 of the latch 160. Longitudinal pullout movement of the cable 300 in a direction away from the bore is countered by mechanical engagement between the second post 180 and the stop 134 of the panel 110. Attempted longitudinal pullout movement of the cable 300 in the direction away from the panel 110 is countered by the shear forces created between the second post 180 and the stop 134. In some aspects, because the latch 160 is free to slide within the slot of the retainer 132, pullout forces acting on the cable 300 do not cause a moment on the latch 160 which could otherwise cause the latch 160 to rotate away from the bore 120 and possibly allow disconnection of the cable 300. Instead, pullout forces acting on the cable 300 load the second post 180 in shear thereby decreasing the likelihood that the cable 300 may be accidentally disconnected. In some aspects, the cable retainer 100 may withstand a pullout force of up to 40 lbf.

In one aspect, through use of mechanical engagement between the connector 305 and the first post 170 and/or the second post 180, the latch 160 of the cable retainer 100 is self-opening. In another aspect, because the latch 160 is configured to bend or flex as it is moved to the disengaged position, after the cable 300 is fully inserted within the bore 120 of the panel 110, the bending or spring-back forces of the latch 160 render the cable retainer 100 self-locking. In other aspects, the cable retainer 100 is capable of self-opening to receive the cable 300 and self-locking to retain the cable 300 within the panel 110 solely through use of the longitudinal pushing force 310.

Figure 4:
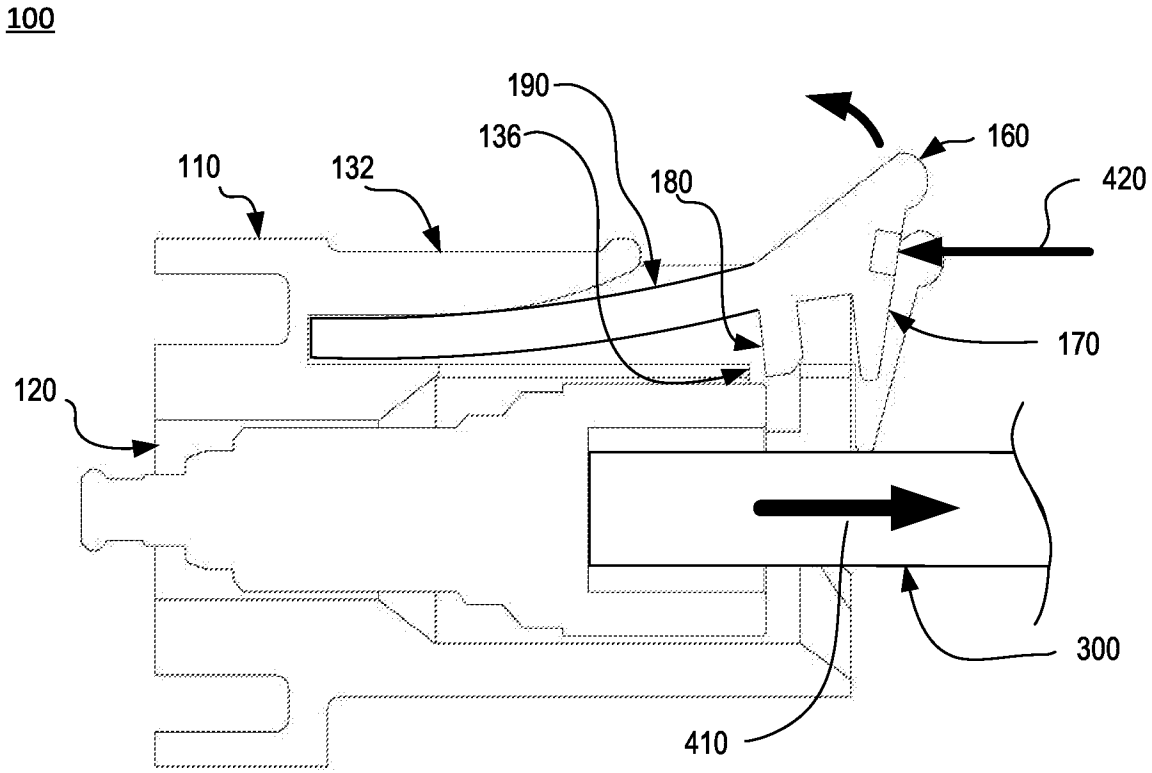
FIG. 4 is a cross sectional view of a self-locking electrical cable retainer, in accordance with various aspects of the subject technology.

FIG. 4 is a cross sectional view of a self-locking electrical cable retainer 100 demonstrating the process for removing or disconnecting the cable 300 from the cable retainer 100, in accordance with various aspects of the subject technology. The cable 300 is shown fully within the bore 120 of the panel 110. To remove or disconnect the cable 300, a user may place a longitudinal pushing force 420 against the first post 170 of the latch 160 using a finger of the user. The longitudinal pushing force 420 acting on the first post 170 causes the elongated member 190 of the latch 160 to move, bend, or flex vertically away from the bore 120 thereby moving the first post 170 and the second post 180 away from the bore 120 and the latch 160 into the disengaged position. As the latch 160 moves into the disengaged position, the gap 136 of the panel guides the second post 180 and latch 160 from the engaged position to the disengaged position. In one aspect, retainer 132 is configured to provide sufficient area for the elongated member 190 of the latch 160 to move, bend or flex into the disengaged position. For example, the retainer 132 may comprise a slot or cavity having an inner surface with a curve or radius that extends from a narrow closed end to a wider opened end.

After the latch 160 is moved to the disengaged position by the longitudinal pushing force 420, the cable may be removed from the bore 120 or disconnected from the panel 110 of the cable retainer 100 by placing a longitudinal pulling force 410 on the cable 300. With the second post 180 moved away from the bore 120, the cable 300 may then be removed or disconnected as desired without disconnecting or affecting neighboring cables. In one aspect, a user may place the longitudinal pushing force 420 on the first post 170 of the latch 160 using a thumb while also placing the longitudinal pulling force 410 on the cable 300 with the remaining fingers of the user, thereby allowing the user to remove or disconnect the cable 300 from the cable retainer 100 using a single hand. In other aspects, by utilizing one latch 160 per cable 300, the cable retainer 100 provides a user the ability to disconnect or remove individual cables 300 without rendering other cables 300 vulnerable to accidental disconnections.

In one aspect, because the latch 160 is disposed vertically over the bore 120, spacing between the plurality of bores 120 along an X-axis or an axis along a horizontal direction may be minimalized thereby increasing the density of ports or bores 120 within the panel 110 along the X-axis. For example, the horizontal spacing between the ports or bores 120 along the X-axis may be substantially the same as a diameter of the bore 120. In another example, the horizontal spacing between the ports or bores 120 along the X axis may be about 0.4 inches, 0.5 inches, 0.6 inches, 0.7 inches, 0.8 inches, 0.9 inches or 1 inch. In other aspects, by only requiring a longitudinal pushing force 420 acting on the first post 170 to release the cable 300, there is no need to provide additional space or area above the latch 160 for a user's finger or tool to release the cable 300, thereby reducing spacing requirements between the plurality of bores 120 along a Y-axis or an axis along a vertical direction and thus further increasing the density of ports or bores 120 within the panel 110 along the Y axis. For example, the vertical spacing between the ports or bores 120 along the Y axis may be about 0.4 inches, 0.5 inches, 0.6 inches, 0.7 inches, 0.8 inches, 0.9 inches or 1 inch.

In some aspects, because the port density of the cable retainer 100 is high, to assist the user in identifying the appropriate port or bore 120 for a particular cable 300, the latches 160 of the cable retainer 100 may have different colors. For example, the cable retainer 100 may comprise numerous ports for various line cards. The latches 160 associated with a first line card may be identified by a first color. The latches 160 associates with a second line card may be identified by a second color that is different from the first color. The latches 160 associated with a third line card may be identified by a third color that is different from the first and second color. Any number of colors may be used to identify the latches 160 associated with any particular line card. In one aspect, the colors of the latches 160 may depend on the function or operation of the corresponding port or bore 120.

Figure 5:
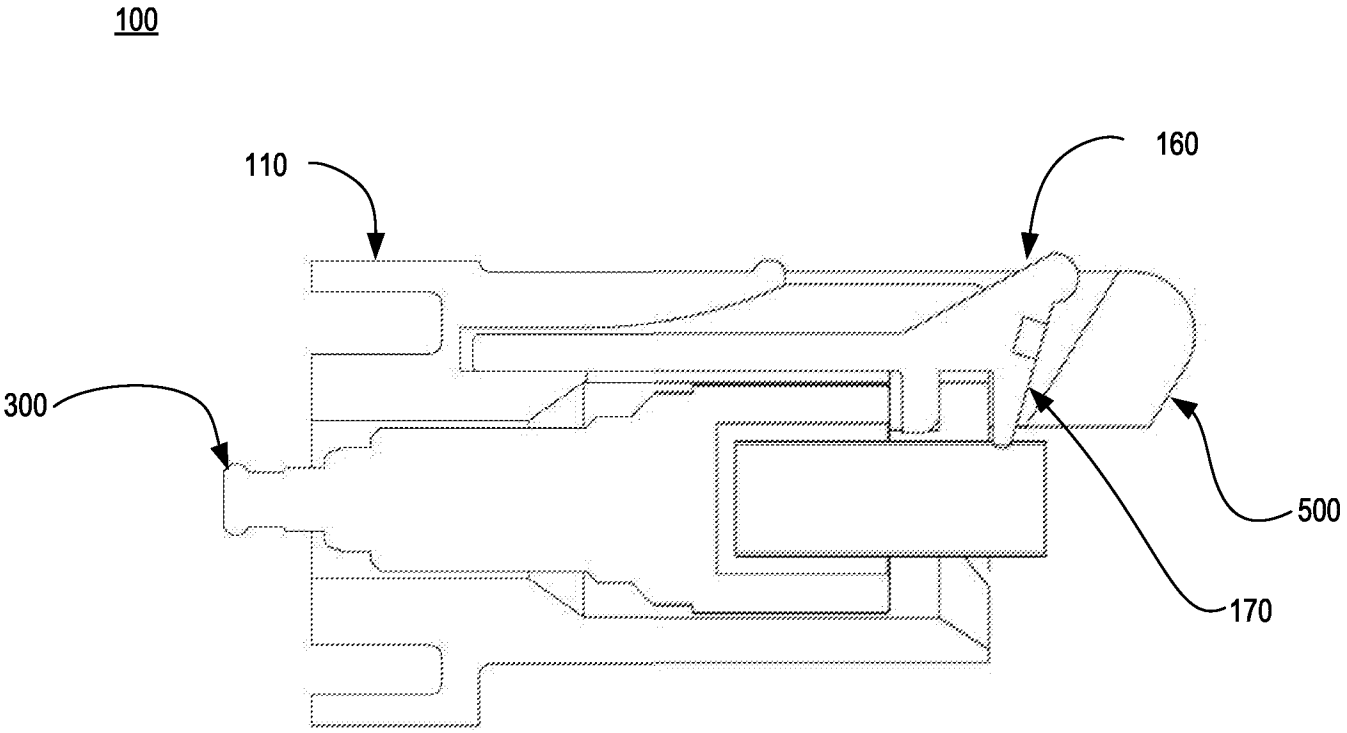
FIG. 5 is a cross sectional view of a self-locking electrical cable retainer with a secondary lock, in accordance with various aspects of the subject technology.

FIG. 5 is a cross sectional view of a self-locking electrical cable retainer 100 with a secondary lock 500, in accordance with various aspects of the subject technology. The secondary lock 500 may comprise a bar configured to extend laterally across the proximal end of the latch 160 of the cable retainer 100 to thereby prevent access to the first post 170 of the latch 160. By disposing the secondary lock 500 at the proximal end of the latch 160, a user's finger cannot access or push the first post 170 of the latch 160. In some aspects, the secondary lock 500 may be attached to the panel 110 via magnets disposed at ends of the secondary lock 500. In another example, the secondary lock 500 may be installed onto the panel 110 via rods extending from the secondary lock 500 that are configured to engage corresponding slots within the panel 110. In yet another example, the secondary lock 500 may be installed onto the panel 110 via protrusions extending from the secondary lock 500 that are configured to engage corresponding detents disposed on the panel 110. In this example, the secondary lock 500 may be held in position via a spring-back force of the secondary lock 500.

Figure 6:
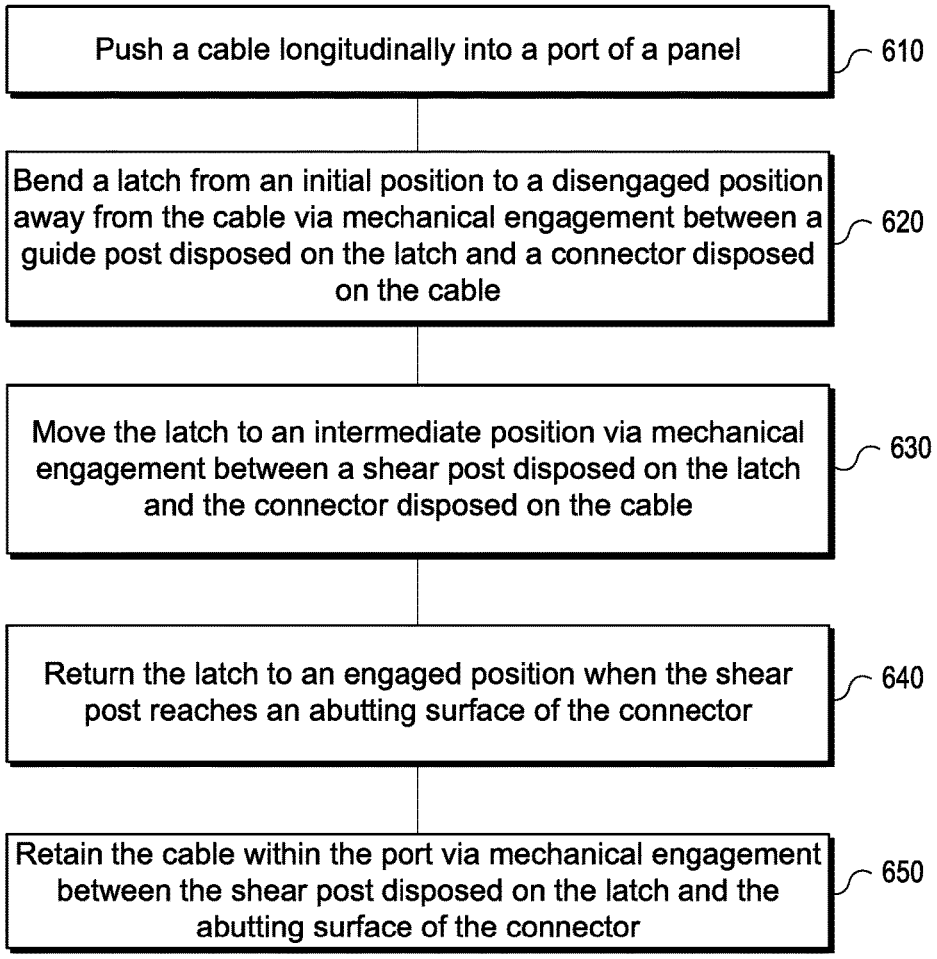
FIG. 6 depicts an example method for retaining a cable within a panel, in accordance with various aspects of the subject technology.

FIG. 6 depicts an example method 600 for retaining a cable within a panel, in accordance with various aspects of the subject technology. It should be understood that, for any process discussed herein, there can be additional, fewer, or alternative steps performed in similar or alternative orders, or in parallel, within the scope of the various embodiments unless otherwise stated.

At operation 610, a cable having a connector at an end is pushed longitudinally into a port or bore of a cable retainer. The cable retainer utilizes a latch to retain the cable. The latch has a guide post at a proximal end and a shear post adjacent to the guide post. As the cable is moved into the port, the outer surface of the connector engages a chamfer on the port to thereby guide the cable toward a centerline of the port.

At operation 620, as the cable is further pushed longitudinally into the port and guided toward the centerline of the port by the chamfer of the port, the latch is bent from an initial position to a disengaged position away from the cable via mechanical engagement between the guide post disposed on the latch and the outer surface of the connector disposed of the cable.

At operation 630, as the cable is further pushed longitudinally into the port and the guide post reaches an abutting surface of the connector of the cable, the latch is moved to an intermediate position toward the cable via mechanical engagement between the shear post disposed on the latch and the outer surface of the connector disposed on the cable. Movement of the latch from the disengaged position to the intermediate position may be accomplished by using bending or spring-back forces within the latch that are created when the latch is bent into the disengaged position.

At operation 640, as the cable is fully pushed longitudinally into the port and the shear post reaches the abutting surface of the connector, the latch returns to an engaged position thereby retaining the cable within the port. Movement of the latch from the intermediate position to the engaged position may be accomplished by using bending or spring-back forces within the latch that are created when the latch is moved, bent, or flexed into the intermediate position. At operation 650, the latch is in the engaged position thereby retaining the cable within the port via mechanical engagement between the shear post disposed on the latch and the abutting surface of the connector. The cable retainer prevents accidental release of the cable from the port by loading the shear post in shear. Specifically, the cable retainer has a stop that is configured to mechanically engage the shear post to thereby load the shear post in shear, as discussed with reference to FIGS. 3A-3D.

To release the cable from the port, a longitudinal pushing force may be placed on the guide post to push the latch from the engaged position to the disengaged position. To prevent accidental release of the cable, a secondary lock may be installed in proximity to the latch to prevent pushing of the latch to release the cable, as described above with reference to FIG. 5.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A cable retainer comprising:

a panel having a bore configured to receive a cable; and a latch having a post, wherein, the panel includes a gap configured to receive the post and guide the latch between an engaged position and a disengaged position, and a stop configured to retain the cable within the bore by mechanically engaging the post, and the post is disposed away from the bore in the disengaged position.

2. The cable retainer of claim 1,
wherein,
the panel includes a retainer with a slot having a curved surface, and
the slot has a first width at a distal end that is narrower than a second width at a proximal end.

3. The cable retainer of claim 1,
wherein,
the panel includes a retainer, and
the latch is operable to slide longitudinally within the retainer.

4. The cable retainer of claim 1, wherein the bore includes a chamfer operable to guide the cable within the bore.

5. The cable retainer of claim 1, further comprising:
another post having a length longer than another length of the post.

6. The cable retainer of claim 1, further comprising:
another post having a rounded end configured to engage a connector on the cable,
wherein,
contact between the rounded end of the another post and the connector causes the latch to move vertically away from the bore and into the disengaged position.

7. The cable retainer of claim 1, wherein the post is disposed within the bore in the engaged position.

8. The cable retainer of claim 1, wherein a material of the latch includes a flexible polymer configured to generate a spring-back force when a portion of the latch is flexed.

9. The cable retainer of claim 1, further comprising:
a secondary lock disposed laterally across the latch.

10. A system for retaining a plurality of cables, the system comprising:
a panel having a plurality of bores, each of the plurality of bores configured to receive one of a plurality of cables; and
a plurality of latches, each of the plurality of latches having a post of a plurality of posts,
wherein,
the panel includes a plurality of gaps, each of the plurality of gaps configured to receive and guide one of the plurality of latches between an engaged position and a disengaged position, each of the plurality of posts disposed away from a corresponding one of the plurality of bores in the disengaged position, and
the panel includes a plurality of stops, each of the plurality of stops configured to retain a respective cable of the plurality of cables within a respective bore of the plurality of bores by mechanically engaging a respective post of the plurality of posts.

11. The system of claim 10, wherein a spacing between each of the plurality of bores is about 0.4 inches.

12. The system of claim 10, wherein each of the plurality of posts is disposed within a corresponding bore in the engaged position.

13. The system of claim 10, further comprising:
another set of posts having rounded ends, each of the rounded ends operable to engage a connector of a respective one of the plurality of cables,
wherein,
contact between each of the rounded ends and its connector causes one of the plurality of latches to move vertically away from the bore and into the disengaged position.

14. The system of claim 10, wherein a material of the plurality of latches includes a flexible polymer configured to generate a spring-back force when the material is flexed.

15. A method for retaining a cable, the method comprising:
bending a latch of panel having a port from an initial position to a disengaged position via mechanical engagement between a post disposed on the latch and a connector disposed on a cable, the post disposed away from the port in the disengaged position;
connecting the cable to the port of the panel;
returning the latch to an engaged position; and
retaining the cable within the port via a stop by mechanical engagement between the stop and the post.

16. The method of claim 15, further comprising:
moving the latch to an intermediate position via mechanical engagement between the post and the connector.

17. The method of claim 15, further comprising:
loading the post to prevent release of the cable from the port.

18. The method of claim 15, further comprising:
pushing the latch to the disengaged position to release the cable from the port.

* * * * *